US008265501B2

(12) United States Patent
Nakagawa

(10) Patent No.: US 8,265,501 B2
(45) Date of Patent: Sep. 11, 2012

(54) IMAGE FORMING APPARATUS FOR DETERMINING THE POSITIONAL RELATIONSHIP BETWEEN AN EXPOSING MEANS AND THE SURFACE OF A PHOTOSENSITIVE BODY

(75) Inventor: Ryohei Nakagawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 442 days.

(21) Appl. No.: 12/626,470

(22) Filed: Nov. 25, 2009

(65) Prior Publication Data

US 2010/0135684 A1 Jun. 3, 2010

(30) Foreign Application Priority Data

Nov. 28, 2008 (JP) ..... 2008-304807

(51) Int. Cl.
*G03G 15/00* (2006.01)
*G03G 15/043* (2006.01)

(52) U.S. Cl. ..... 399/49; 399/51

(58) Field of Classification Search ..... 399/49, 399/51, 72, 301; 347/116, 240
See application file for complete search history.

(56) References Cited

U.S. PATENT DOCUMENTS

| | | | | |
|---|---|---|---|---|
| 5,182,575 | A * | 1/1993 | Kato et al. | 347/240 |
| 6,434,346 | B1 * | 8/2002 | Knott et al. | 399/49 |
| 7,664,407 | B2 * | 2/2010 | Yamanaka et al. | 347/116 |
| 8,131,193 | B2 * | 3/2012 | Takezawa | 399/301 |

FOREIGN PATENT DOCUMENTS

| | | | |
|---|---|---|---|
| JP | H07-270673 | A | 10/1995 |
| JP | 2001-125347 | A | 5/2001 |
| JP | 2004-167728 | A | 6/2004 |
| JP | 2004-306454 | A | 11/2004 |
| JP | 2005-017672 | A | 1/2005 |
| JP | 2006-047407 | A | 2/2006 |

OTHER PUBLICATIONS

Japan Patent Office; Notification of Reasons for Refusal for Japanese Patent Application No. 2008-304807, dated Sep. 21, 2010.

* cited by examiner

*Primary Examiner* — William J Royer

(74) *Attorney, Agent, or Firm* — Baker Botts L.L.P.

(57) ABSTRACT

An image forming apparatus, having an exposing unit for exposing a photosensitive body to form a_latent image, a developing unit for forming a developer image corresponding to the latent image, a carrier body moved through a portion opposite to the photosensitive body onto which the developer image formed on the photosensitive body is transferred, a mark forming unit for controlling the exposing unit to form a mark on a surface of the carrier body, a light sensor for sensing light reflected by the carrier body, an edge detector for sensing an edge of the mark on the carrier body based on an_output of the light sensor and a deciding unit for deciding a positional relation between a focal point of the exposing unit and the surface of the photosensitive body based on the edge detected by the edge detector.

8 Claims, 13 Drawing Sheets

IMAGE FORMING APPARATUS FOR DETERMINING THE POSITIONAL RELATIONSHIP BETWEEN AN EXPOSING MEANS AND THE SURFACE OF A PHOTOSENSITIVE BODY

CROSS REFERENCE TO RELATED APPLICATION

The present application claims priority from Japanese Patent Application No. 2008-304807 filed on Nov. 28, 2008, the disclosure of which is incorporated herein by reference in its entirety.

BACKGROUND

The present invention relates to an image forming apparatus for forming an electrostatic latent image by exposing a surface of a photosensitive body by means of an exposing means, and forming an image corresponding to the electrostatic latent image by causing a developer to attach to the electrostatic latent image.

Previously, an image forming apparatus equipped with exposing means for exposing a surface of a photosensitive body to form an electrostatic latent image on the surface of the photosensitive body, and developing means for attaching developer onto the electrostatic latent image to form a developer image corresponding to the electrostatic latent image on the surface of the photosensitive body have been considered. In the image forming apparatus of this type, the image corresponding to the electrostatic latent image can be formed on a recording medium such as paper, or the like by passing the recording medium through a portion opposite to the photosensitive body to transfer the developer image formed on the photosensitive body onto the recorded medium.

However, in the image forming apparatus of this type, a positional relation between a focal point of the exposing means and the surface of the photosensitive body can become displaced from a normal position and thus, light from the exposing means does not focus on the surface of the photosensitive body, and in some cases an isolated dot may disappear or a density in a halftone portion may be increased. Therefore, in the image forming apparatus of the type having a belt that is circulated through the portion opposite to the photosensitive body, the related art proposes that a mark be formed in a halftone on a surface of the belt, then a density of the mark be sensed by a density sensor, and then, based on the sensed result, it be determined whether or not the light from the exposing means is now focused on the photosensitive body.

SUMMARY

However, in order to precisely measure precisely a density of a halftone, an expensive density sensor must be employed. Further, even though the density sensor may be employed, there is still a limit to the improvement of accuracy when deciding the positional relation between the focal point of the exposing means and the surface of the photosensitive body. Therefore, embodiments of the present invention provide an image forming apparatus capable of deciding whether or not a positional relation between a focal point of an exposing means and a surface of a photosensitive body is correct.

According to exemplary embodiments of the invention, there is provided an image forming apparatus, comprising:

a photosensitive body;

an exposing unit which exposes a surface of the photosensitive body to form an electrostatic latent image on the surface of the photosensitive body;

a developing unit which attaches a developer to the electrostatic latent image to form a developer image corresponding to the electrostatic latent image formed on the surface of the photosensitive body;

a carrier body, which is moved through a portion opposite to the photosensitive body and onto which the developer image formed on the photosensitive body is to be transferred;

a mark forming unit which controls the exposing unit to form a mark made from the developer image on a surface of the carrier body;

a light sensor which senses light reflected by the carrier body;

an edge detector which senses edges of the mark formed on the surface of the carrier body based on an output of the light sensor; and a deciding unit which decides a positional relation between a focal point of the exposing unit and the surface of the photosensitive body based on the edge detected by the edge detector.

DETAIL DESCRIPTION OF EXEMPLARY EMBODIMENTS

Figure 1:
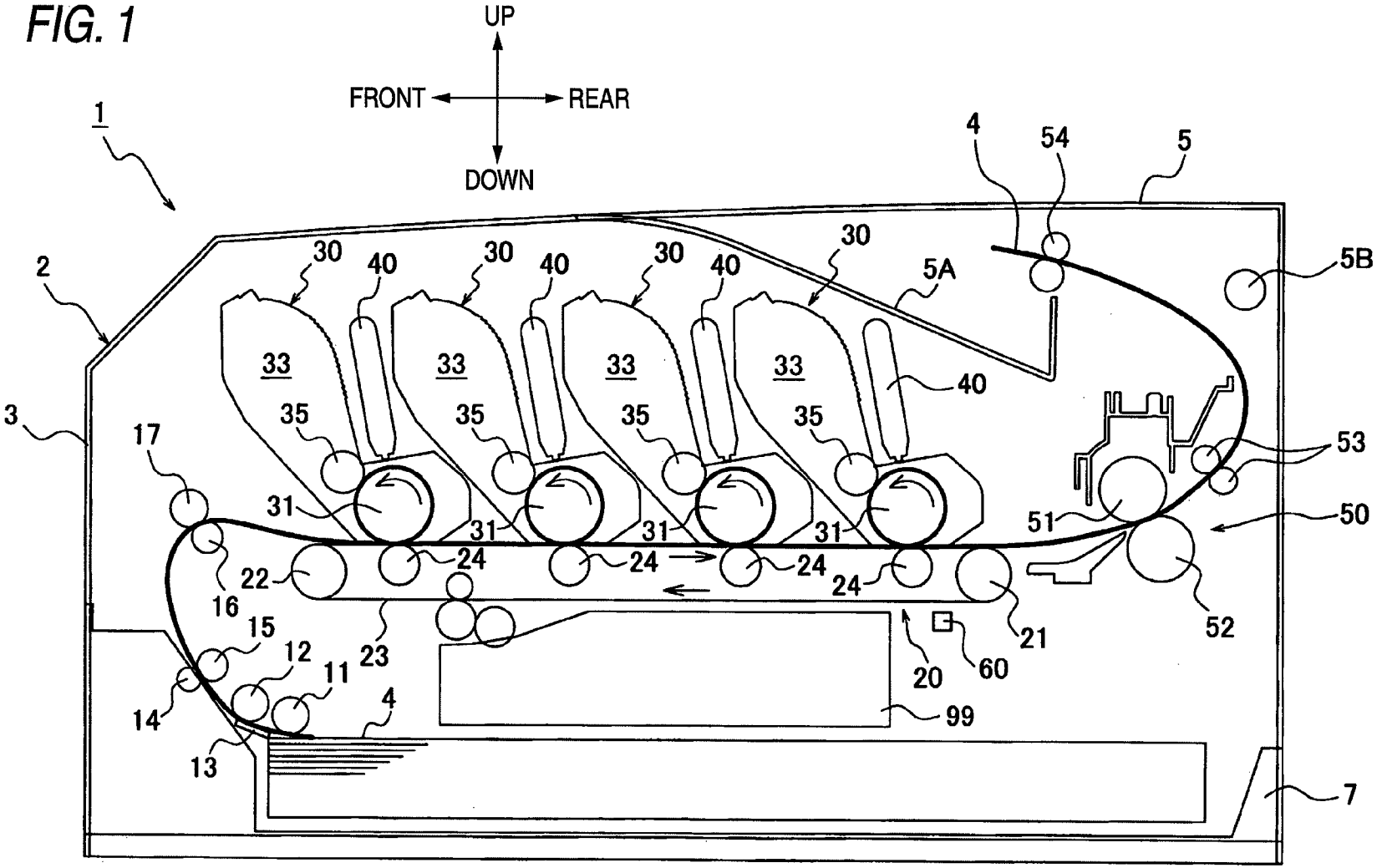
FIG. 1 is a side sectional view showing a schematic configuration of an exemplary embodiment of an image forming apparatus consistent with the present invention.

An exemplary embodiment of the present invention will be explained with reference to the enclosed drawings hereinafter. FIG. 1 is a side sectional view showing a schematic configuration of an exemplary embodiment of an image forming apparatus 1 consistent with the present invention. In the following explanation, the left side in FIG. 1 is referred to as the front side of the image forming apparatus 1, and the right side in FIG. 1 is referred to as the rear side of the image forming apparatus 1.

This embodiment of the image forming apparatus 1 is a direct transfer tandem type color printer, and is equipped with a box-shaped housing 2, as shown in FIG. 1. A front cover 3 is provided on the front surface of the housing 2 (main body). Further, a paper eject tray 5A, into which papers 4 are ejected after image formation, is formed on the top surface of the housing 2. A top cover 5 is provided to open/close around the rear top end of the image forming apparatus 1 (see FIG. 2). This top cover 5 is an example of a holding unit provided integrally with the paper eject tray 5A, to cover the image forming apparatus 1 from the top. An image forming unit 30 and a belt unit 20, described later, can be pulled out upwardly from the interior of the housing 2 when the top cover 5 is opened.

A paper feed tray 7 is fitted to the bottom portion of the housing 2 such that the paper feed tray 7 can be pulled out in the forward direction. The papers 4, onto which an image is to be formed, are contained in the paper feed tray 7. A pressure plate (not shown) is provided in the paper feed tray 7 such that the pressure plate can support the paper 4 loaded thereon and can be tilted to lift up a front end side of the paper 4. Further, a paper feeding roller 11 is provided in the front end upper position of the paper feed tray 7 to carry the paper 4. A separating roller 12 and a separating pad 13 for separating the paper 4 carried by the paper feeding roller 11 are provided on the downstream side, in the paper carrying direction, of the paper feeding roller 11.

The uppermost sheet of paper 4 in the paper feed tray 7 is separated by the separating roller 12, is placed between a paper dust collecting roller 14 and an opposing roller 15 and is carried by the paper dust collecting roller 14 and the opposing roller 15, and is fed between a pair of registration rollers 16, 17. The registration rollers 16, 17 feed the paper 4 onto the belt unit 20 located on the downstream side at a predetermined timing.

The belt unit 20 is detachably attached to the housing 2. The belt unit 20 is equipped with a carrying belt 23 (so-called transfer carrying belt; an example of a carrier body). This carrying belt 23 is stretched horizontally between a belt driving roller 21 and a tension roller 22, with both rollers 21, 22 being arranged longitudinally at a distance. The carrying belt 23 is an endless belt formed of a resin material such as polycarbonate, or the like. The carrying belt 23 is circulated clockwise in FIG. 1 when the belt driving roller 21 located on the rear side is rotated/driven, and carries the paper 4 loaded thereon backward.

Four transfer rollers 24 are aligned at a predetermined interval along the longitudinal direction of the inner side of the carrying belt 23. These transfer rollers 24 are arranged to oppose respective photosensitive drums 31 (an example of a photosensitive body) described later, which are provided corresponding to the image forming units 30. The carrying belt 23 is disposed between respective photosensitive drums 31 and the corresponding transfer rollers 24. When the toner image, described later, is transferred, a transfer bias is applied between the transfer rollers 24 and the photosensitive drums 31, and a predetermined quantity of transfer current is supplied.

The image forming unit 30 is paired with an LED unit 40 (an example of the exposing unit), and four image forming units 30 are provided to correspond to the colors of black, yellow, magenta, and cyan, respectively. The image forming units 30 and the LED units 40 are provided in series along the carrying direction of the paper 4.

Each image forming unit 30 comprises a photosensitive drum 31, a toner container 33, a developing roller 35 (an example of the developing unit), and the like. The photosensitive drum 31 has a drum main body made of metal that is grounded, and the photosensitive drum 31 is formed by coating its surface with a positively chargeable photosensitive layer. The surface of the photosensitive drum 31 is charged by a charging wire 36 (not shown in FIG. 1, see FIG. 5A) during turning, and is then exposed by LEDs (not shown) disposed at the bottom of the LED unit 40. Accordingly, the electrostatic latent image, which corresponding to the image to be formed on the paper 4, can be formed.

As a developer, a positively chargeable nonmagnetic mono-component toner T (see FIG. 5A) for each color of black, yellow, magenta, and cyan is contained in the respective toner containers 33. The toner T contained in the toner container 33 is positively charged by friction caused by the rotation of the developing roller 35, and the like, and is borne on the developing roller 35 as a thin layer of predetermined thickness. When the positively charged toner T is carried on the developing roller 35 and charged positively contacts opposing photosensitive drum 31 due to the rotation of the developing roller 35, the toner T is supplied to the electrostatic latent image formed on the surface of the photosensitive drum 31. As a result, the electrostatic latent image formed on the photosensitive drum 31 is rendered visible, and the toner image (an example of the developer image) is formed when the toner T attaches only to the exposed area borne on the surface of the photosensitive drum 31.

Then, the toner images borne on the surface of respective photosensitive drums 31 are transferred sequentially onto the paper 4 by the transfer current while the paper 4 carried by the carrying belt 23 passes between the photosensitive drums 31 and the transfer rollers 24. Then, the paper 4 onto which respective color toner images are transferred in this manner is carried to a fixing unit 50.

The fixing unit 50 is arranged at the rear side of the belt unit 20 in the housing 2. This fixing unit 50 is equipped with a heating roller 51, which has a heat source such as a halogen lamp, or the like, and which is rotated or driven, and a pressure roller 52 is arranged opposite to the heating roller 51 to press the heating roller 51 and is rotated as a follower. In this fixing unit 50, the toner image is fixed onto the paper 4 when the paper 4, onto which the toner images in respective colors are transferred, is heated while being placed between the heating roller 51 and the pressure roller 52 and carried downstream. The paper 4 on which the toner images are fixed is further carried by a carrying roller 53 that is arranged obliquely to the upper back of the fixing unit 50, and is ejected onto the paper eject tray 5A by a paper ejecting roller 54 provided at the top portion of the housing 2.

Further, registration sensors 60 are provided at a location that is positioned obliquely below the belt driving roller 21 and opposite to the surface of the carrying belt 23. Although described later, this registration sensor 60 is known, and is used herein to sense the patch P, and the like when the patch P (see FIG. 3A) (an example of the mark) and the like is formed on the carrying belt 23 by the image forming unit 30. Also, a belt cleaner 99 contacts a lower surface of the carrying belt 23, which is stretched between the belt driving roller 21 and the tension roller 22. This belt cleaner 99 is known, and is used herein to erase the patch P, and the like formed on the surface of the carrying belt 23.

Figure 2:
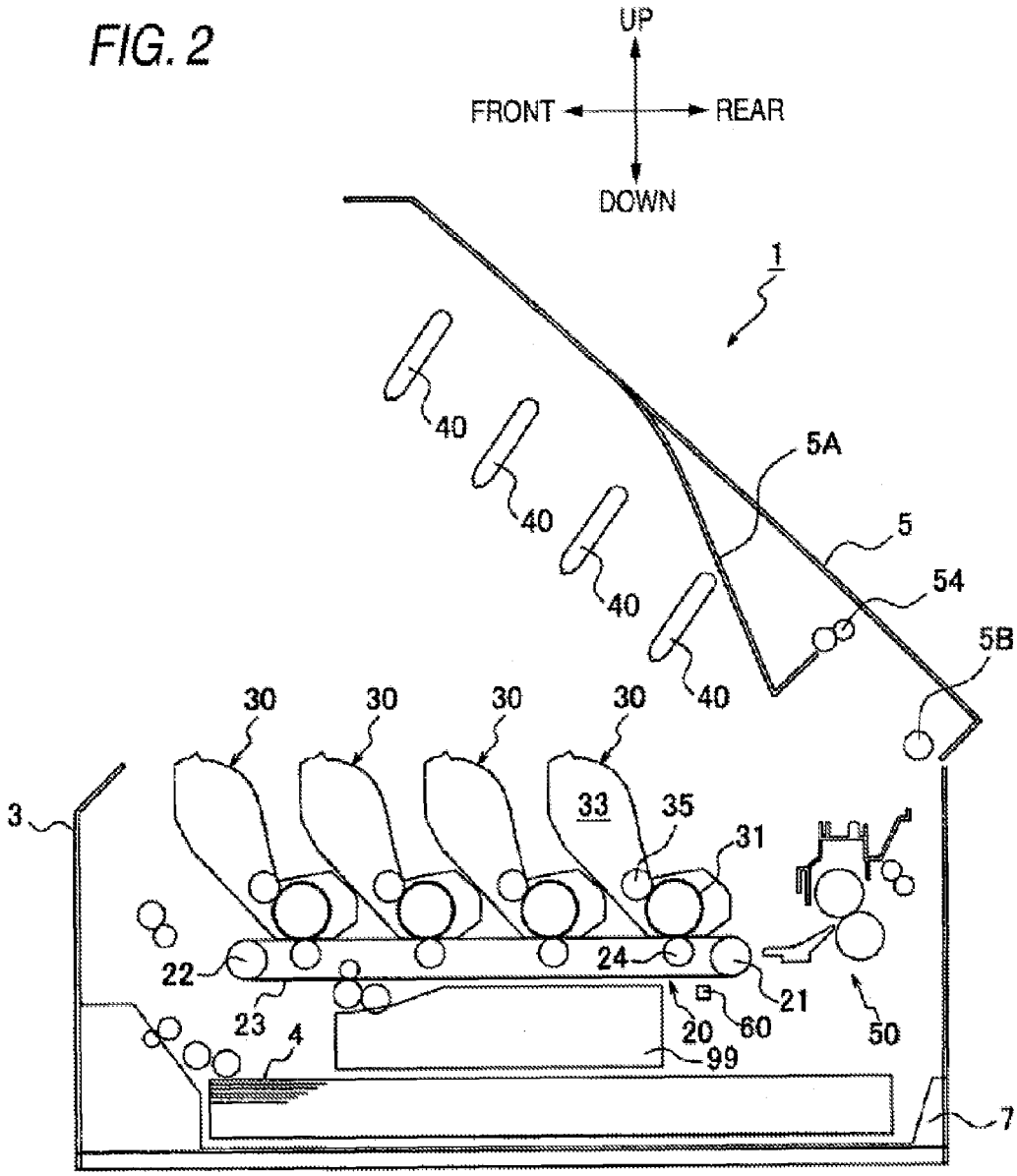
FIG. 2 is a side sectional view showing an operation of a top cover of the exemplary embodiment of the image forming apparatus.

Also, as shown in FIG. 2, the top cover 5 is turned on a shaft 5B provided at the rear end in the lateral direction (i.e., direction that intersects orthogonally with the moving direction of the carrying belt 23). Four LED units 40 are connected swingably to a lower surface of the top cover 5 via a connection link (not shown). Therefore, as shown in FIG. 2, the LED units 40 can be moved way from the photosensitive drums 31 by opening the top cover 5. Also, as shown in FIG. 1, the LED units 40 can be provided in a position opposing the photosensitive drums 31 by closing the top cover 5.

Figure 3:
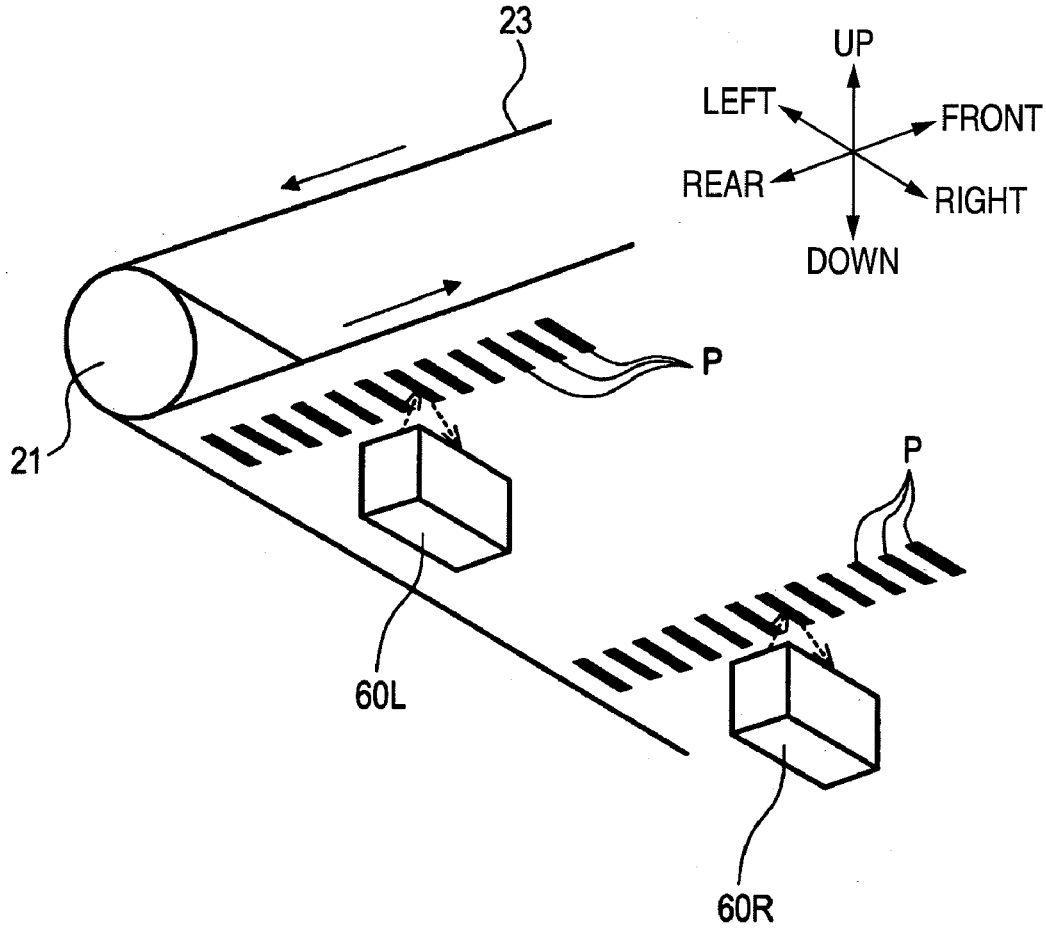
FIG. 3A is a perspective view and FIG. 3B is a side view, each showing an exemplary embodiment of a registration sensor of the image forming apparatus.
Figure 3:
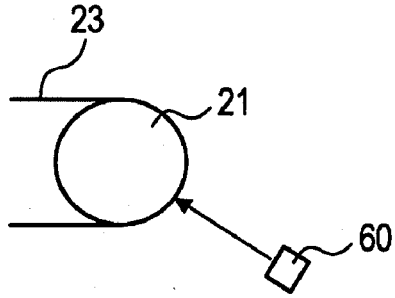

As shown in FIG. 3A, a pair of registration sensors 60 (60L, 60R) is provided near both lateral ends of the carrying belt 23, opposite to the lower surface of the carrying belt 23, which is turned by the belt driving roller 21. In the following explanation of the registration sensor 60, suffixes L and R are affixed to discriminate between the left and right sides, and the suffixes are omitted when no discrimination is needed. Also, as shown in FIG. 3B, the registration sensors 60 may be arranged to oppose the carrying belt 23, which is curved along the surface of the belt driving roller 21.

Figure 4:
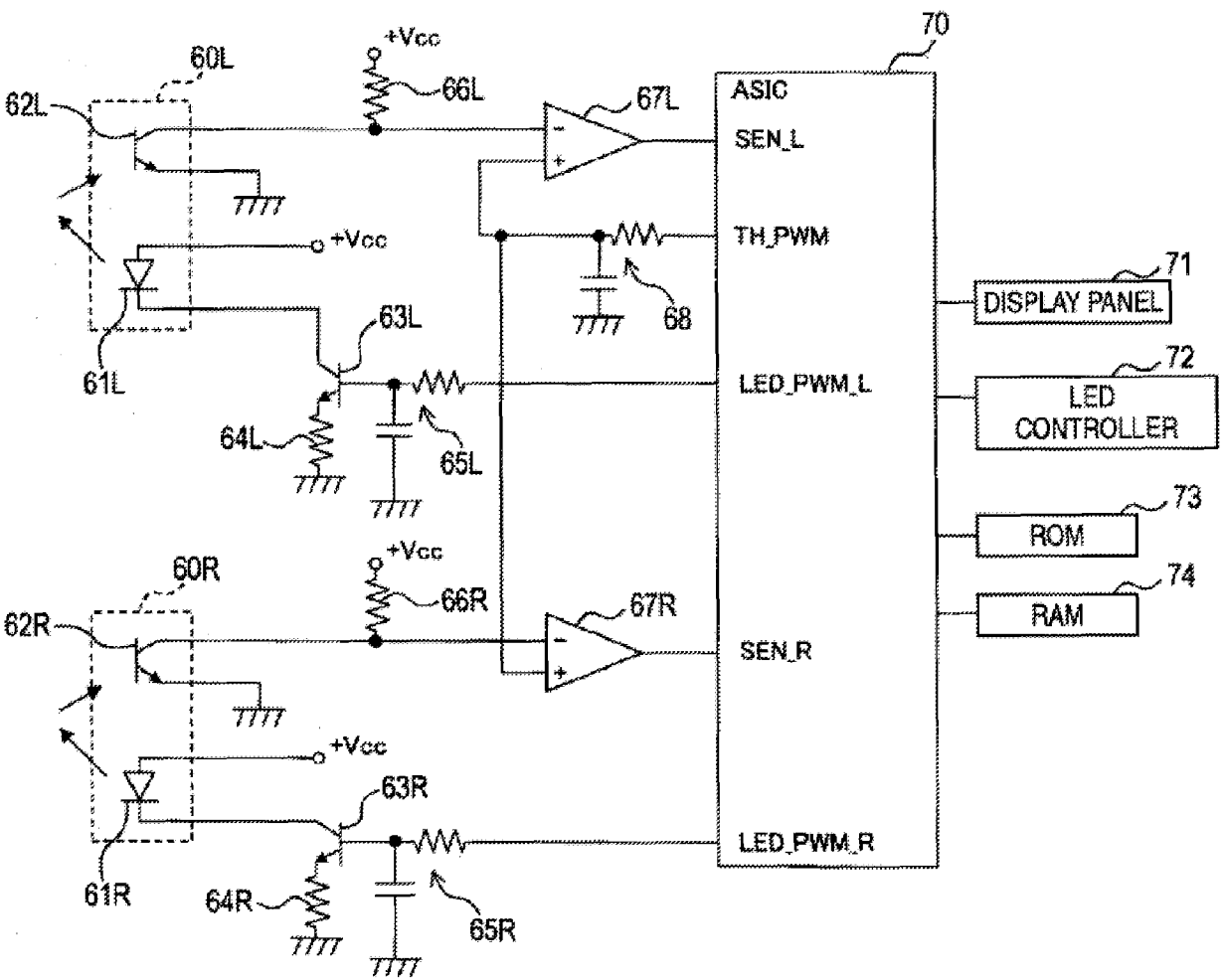
FIG. 4 is a circuit diagram showing an exemplary embodiment of the registration sensor and an exemplary embodiment of a related control system.

Also, as shown in FIG. 4, each registration sensor 60L, 60R has an infrared light emitting diode 61L, 61R for irradiating an infrared light onto the carrying belt 23, and a phototransistor 62L, 62R (an example of a light sensor) senses light from reflected from the carrying belt 23. An anode of the infrared light emitting diode 61L, 61R of each registration sensor 60L, 60R is connected to a DC current source Vcc, and a cathode of the light emitting diode 61L, 61R of each registration sensor 60L, 60R is grounded via a transistor 61L, 61R and a resistor 64L, 64R.

A PWM signal being output from an LED_PWM_L terminal of an ASIC (Application Specific Integrated Circuit) 70 is input into a base of the transistor 63L according to the left-side registration sensor 60L via a smoothing circuit 65L consisting of a capacitor and a resistor. Similarly, a PWM signal being output from an LED_PWM_R terminal of the ASIC 70 is input into a base of the transistor 63R according to the right-side registration sensor 60R via a smoothing circuit 65R consisting of a capacitor and a resistor. Therefore, an intensity of light emission of each infrared light emitting diode 61L, 61R is controlled to a predetermined quantity of light in response to the duty ratio of each PWM signal output from the ASIC 70.

The collector of the phototransistor 62L, 62R of each registration sensor 60L, 60R is connected to the DC current source Vcc via a resistor 66L, 66R, and an emitter of the phototransistor 62L, 62R of each registration sensor 60L, 60R is grounded. Also, collector voltages of phototransistors 62L, 62R (also referred to as "sensor outputs" hereinafter) are input into inverting input terminals of comparators 67L, 67R, respectively. A PWM signal being output from a TH_PWM terminal of the ASIC 70 is input into the non-inverting input terminals of the comparators 67L, 67R via a smoothing circuit 68 consisting of a capacitor and a resistor. Therefore, a voltage corresponding to a duty ratio of the PWM signal being output from the TH_PWM terminal (also referred to as a "comparator threshold" hereinafter) and the sensor outputs are compared with each other by the comparators 67L, 67R respectively, and the result is input into a SEN_L terminal or a SEN_R terminal of the ASIC 70.

Also, a display panel 71 (an example of a displaying unit) is provided on the surface of the housing 2, an LED controller 72 is provided to control a light emitting state of respective LEDs of respective LED units 40, and a ROM 73, and a RAM 74 are connected to the ASIC 70.

In the image forming apparatus 1 constructed as discussed above, when the top cover 5 is not completely closed, the focal points of the LEDs provided to the LED unit 40 are not placed on the surface of the photosensitive drum 31, and the lights emitted from the LEDs do not converge onto the surface of the photosensitive drum 31. When a so-called focal shift, such as this, is caused, the isolated dots can disappear or a density in a halftone portion can be increased, as explained hereunder.

Figure 5:
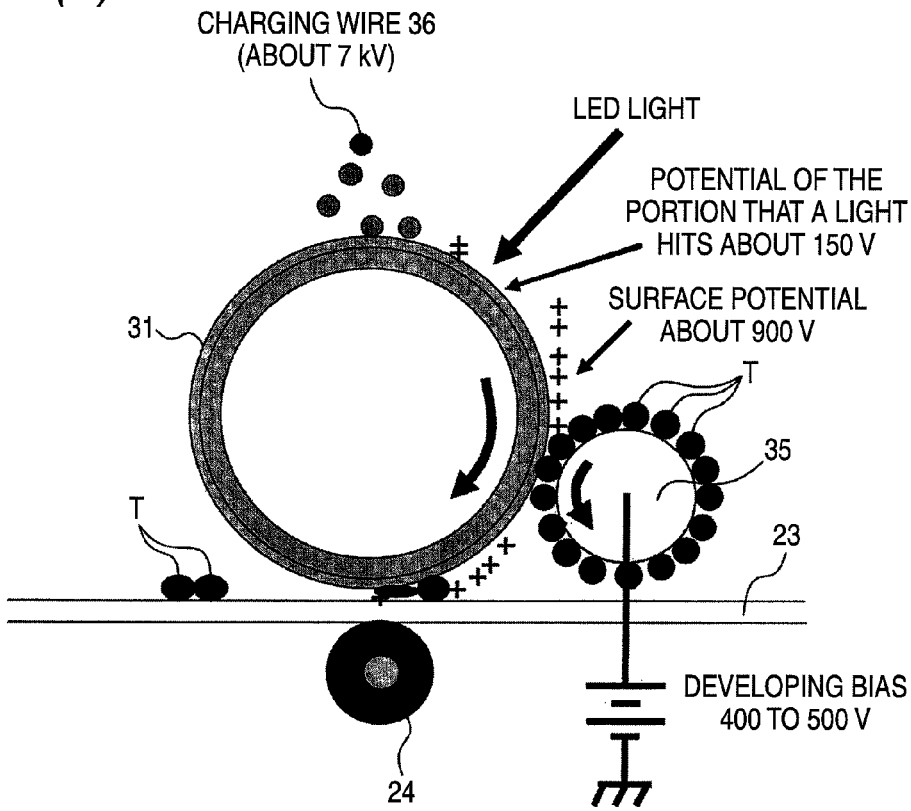
FIGS. 5A and 5B are explanatory views schematically showing image formation by an exemplary embodiment of an image forming apparatus.
Figure 5:
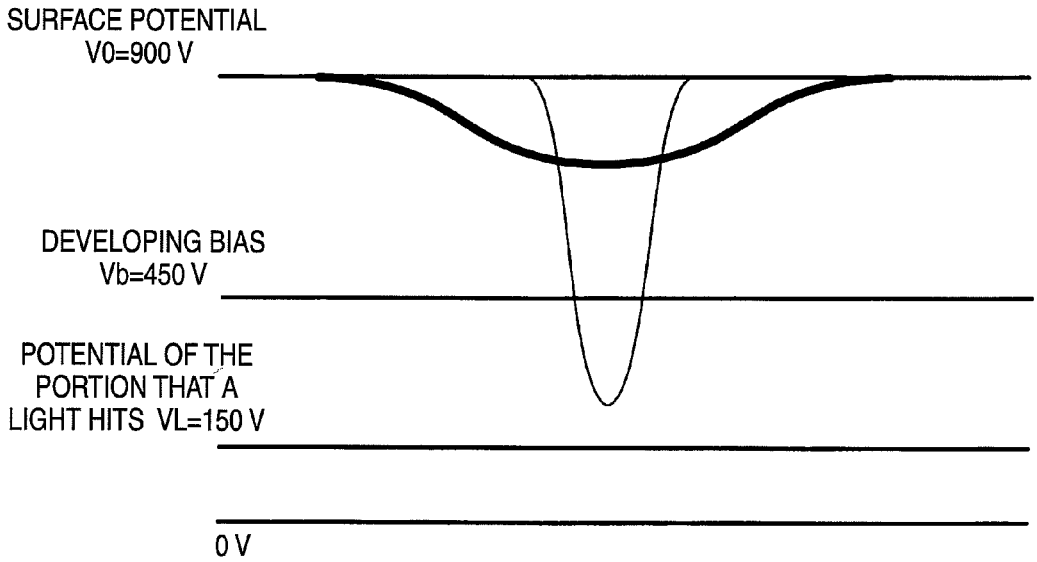

FIG. 5A is an explanatory view showing schematically the principles applied to form the image on the surface of the carrying belt 23 by the image forming unit 30. As shown in FIG. 5A, first the surface of the photosensitive drum 31 is uniformly, positively charged to about 900 V by the charging wire 36 to which a voltage of about 7 kV is applied. Then, when the exposure light is applied by the LED unit 40 and the potential of the portion that a light hits is lowered to around 150 V.

Conversely, the toner T is positively charged by friction, and is then carried on the developing roller 35 to which a developing bias of 400 to 500 V is applied. Therefore, when the toner T borne on the developing roller 35 is disposed opposite to the photosensitive drum 31 and comes in contact therewith according to the rotation of the developing roller 35, toner T attaches to the portion of the surface of the photosensitive drum 31 having a potential that has been decreased to less than the developing bias. The toner T carried on the surface of the photosensitive drum 31 in this manner is transferred onto the carrying belt 23 by the transfer current when the photosensitive drum 31 is disposed opposite to the transfer roller 24 via the carrying belt 23.

In this manner, when no focal shift has been caused, a potential of the portion that light hits becomes lower than the developing bias as indicated with a thin line in FIG. 5B, and the toner T attaches satisfactorily to the photosensitive drum 31. However, as indicated with a thick line in FIG. 5B, when the LED light spreads into a wider range due to the occurrence of a focal shift, the surface potential of the photosensitive drum 31 becomes lower than the developing bias, and in some cases, a black (or other employed color) isolated dot D1 (see FIG. 6C, for example), may disappear.

Figure 6:
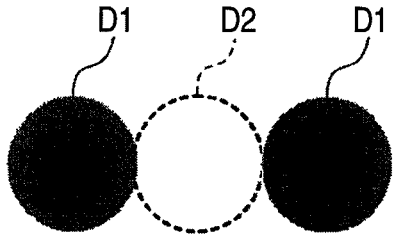
FIGS. 6A to 6D are explanatory views schematically showing isolated dot loss caused due to a focal shift.
Figure 6:
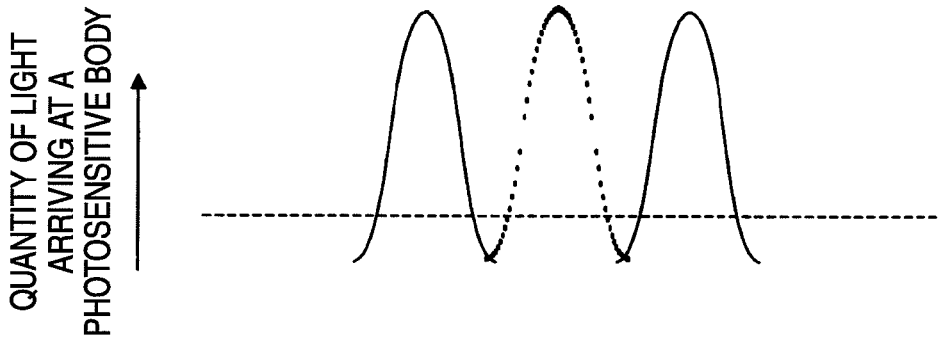
Figure 6:
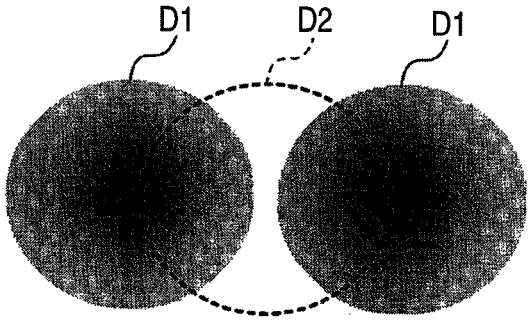
Figure 6:
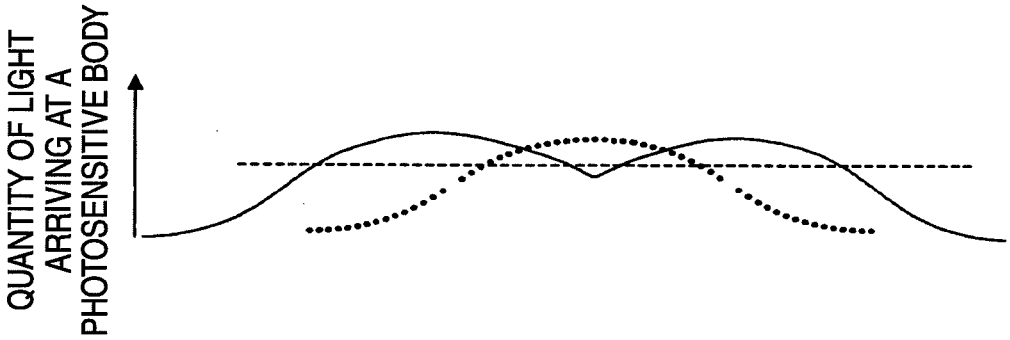

Further, the LED light should reach the photosensitive drum 31 essentially in a distribution as shown in FIG. 6B. Nevertheless, the light may spread out due to a focal shift as shown in FIG. 6D, and then exceeds a threshold at which the toner T attaches to the photosensitive drum 31 (illustrated by a dotted line in FIGS. 6B and 6D) over a larger range. In this case, sometimes a white isolated dot D2 may disappear as explained hereunder. That is, essentially a black (or another employed color) isolated dot D1 and a white isolated dot D2 should be aligned alternately, as shown in FIG. 6A, but the black isolated dot D1 may actually spread due to a focal shift, and the white isolated dot D2 may disappear, as shown in FIG. 6C.

Figure 7:
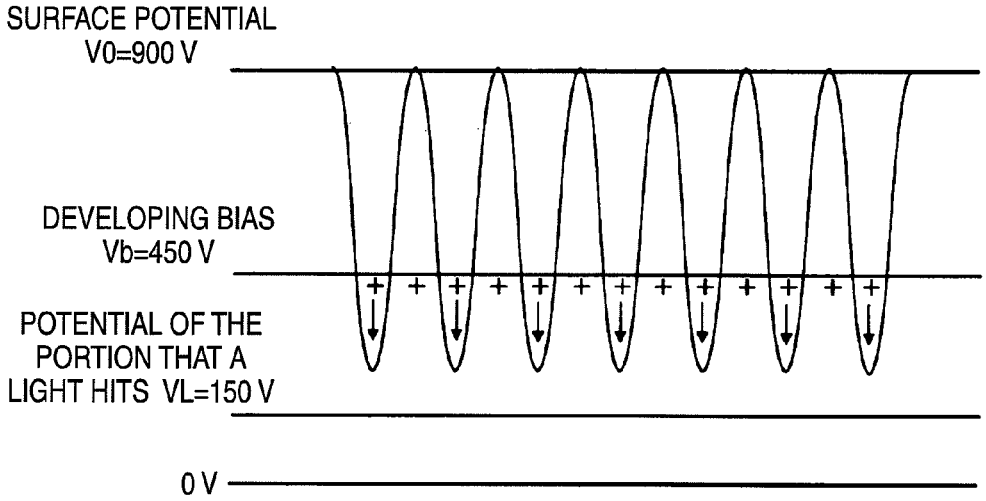
FIGS. 7A and 7B are explanatory views schematically showing a potential change of a halftone portion caused by a focal shift.
Figure 7:
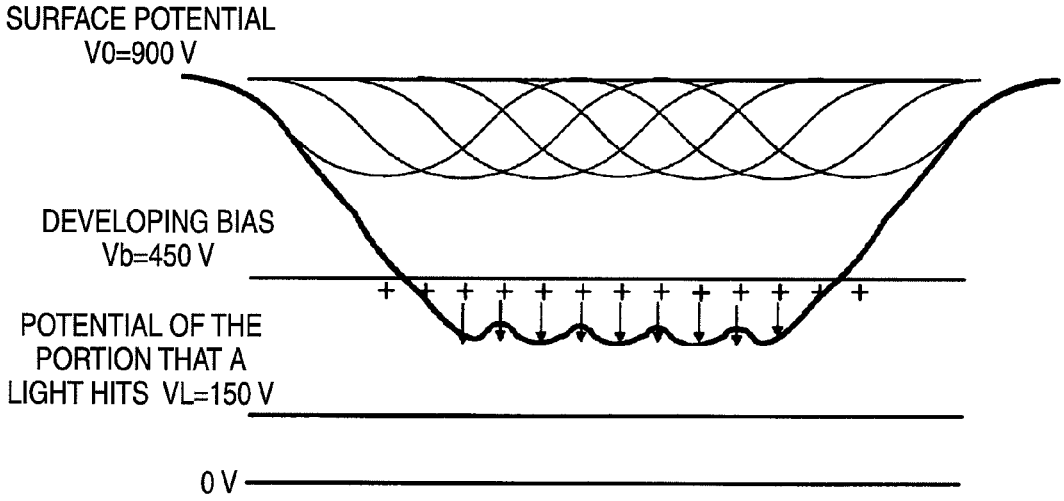

Further, as shown in FIG. 7A, when the image in a halftone image is formed by discretely exposing the photosensitive drum 31 to a lower surface potential of the photosensitive drum 31, in some cases a density in a halftone portion may be increased due to the focal shift. In other words, as shown by the thin line in FIG. 7B, when individual reductions in potential caused by the discrete exposure have spread, the overall surface potential of the photosensitive drum 31, derived by integrating the spread potential reduction, falls below the developing bias over a wide width indicated with a thick line in FIG. 7B. Therefore, the toner T is transferred onto the location where the toner T should not be transferred, and a density of the halftone portion is increased.

Figure 8:
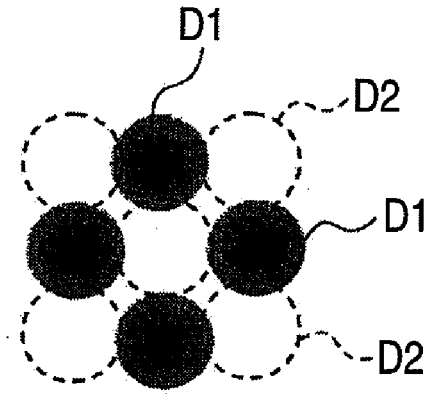
FIGS. 8A and 8B are explanatory views schematically showing density change of the halftone portion due to the focal shift.
Figure 8:
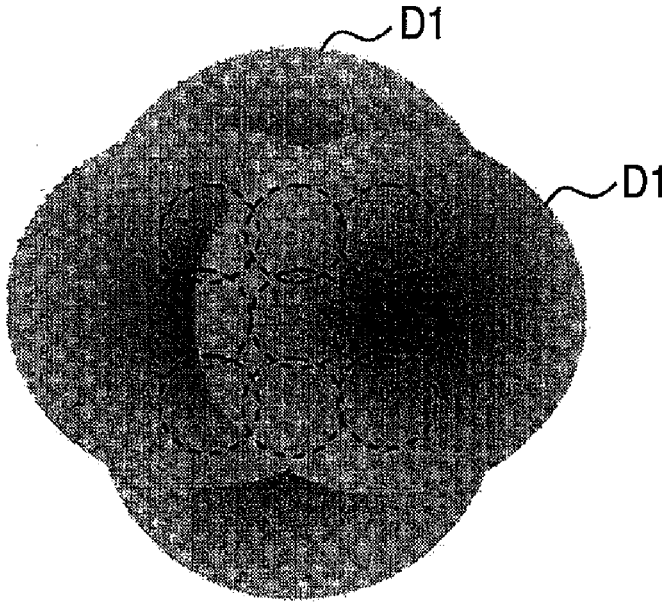

In this case, for example, as shown in FIG. 8A, when the halftone portion is formed by four black (or any other employed color) isolated dots D1 and five white isolated dots D2, an area of the black isolated dots D1 is increased due to the focal shift when such shift, and a density of the halftone portion is increased, as shown in FIG. 8B.

Figure 9:
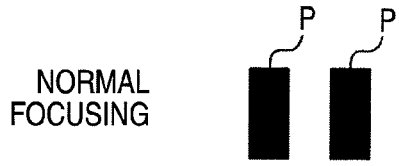
FIGS. 9A to 9I are explanatory views showing determining focal shift based on processes in the exemplary embodiment of the image forming apparatus.
Figure 9:
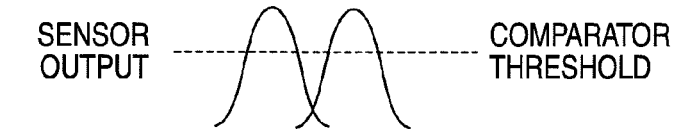
Figure 9:
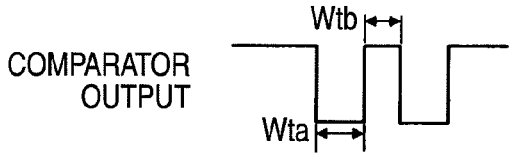
Figure 9:
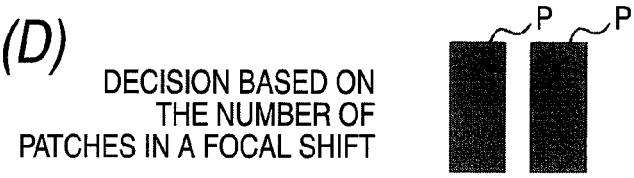
Figure 9:
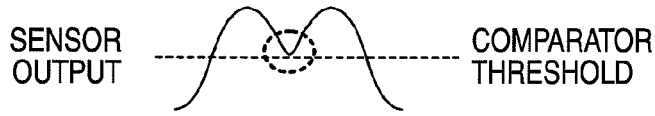
Figure 9:
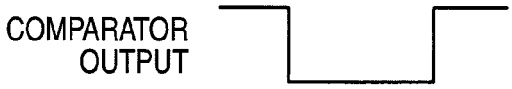
Figure 9:
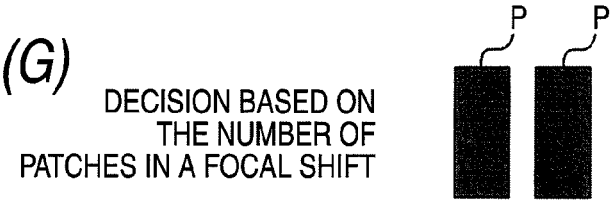
Figure 9:
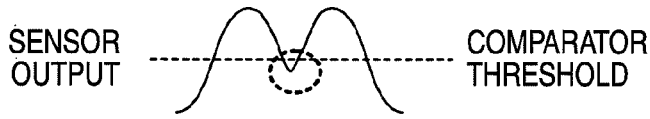
Figure 9:
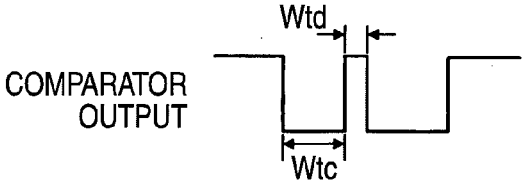

Therefore, in the present embodiment, as shown in FIG. 3A and FIG. 9A, one of the image forming units 30 forms plural pairs of rectangular patches P, which are long in the lateral direction, on both ends of the carrying belt 23 in the lateral direction, and then the focal shift is sensed.

As shown in FIG. 9A, when two patches P pass sequentially through the opposing positions of the registration sensors 60, the sensor output obtained from the sensors 60 changes, as shown in FIG. 9B. Thus, a comparator output derived by comparing the sensor outputs and a comparator threshold being set by the PWM signal by means of a comparator is also changed, as shown in FIG. 9C.

Here, a timer is built into the ASIC 70, and a width of the patch P (a length in the longitudinal direction: referred to as a "patch width" hereinafter) and an interval between the patches P (referred to as a "patch interval" hereinafter) can be calculated by counting intervals of timings at which the comparator output changes. When no focal shift is caused, as shown in FIG. 9A (also referred to as a "normal focusing" hereinafter), the patch width is assumed as Wta, and the patch interval is assumed as Wtb. In these examples, the value corresponding to the developing bias is not always set as the comparator threshold.

When the patch interval is widened due to the occurrence of the focal shift, the sensor output does not fall below the comparator threshold between the patches P, as shown in FIGS. 9D & 9E. Thus, the comparator output is changed as shown in FIG. 9F. In this case, since the sensor output extends over plural comparator thresholds, the number of sensed edges of the patches P becomes two and the number of sensed patches P can be decreased.

Also, as shown in FIG. 9G, even when a change of the patch width due to the focal shift is smaller than in the example of FIG. 9D, a change of the sensor output and a change of the comparator output are also changed, as shown in FIGS. 9H and 91. That is, a patch width Wtc becomes larger than the patch width Wta in the normal operation, and a patch interval Wtd becomes smaller than the patch interval Wtb in the normal operation.

Therefore, the ASIC 70 executes the following processes based on a program stored in the ROM 73, and informs the user of the occurrence of focal shifts. Regarding this process, explanation will be made with reference to a flowchart in FIG. 10. In this example, the process is applied individually to the left-side and right-side registration sensors 60L, 60R at a predetermined timing, e.g., when the power supply is turned ON, the top cover 5 is closed, or the like.

Figure 10:
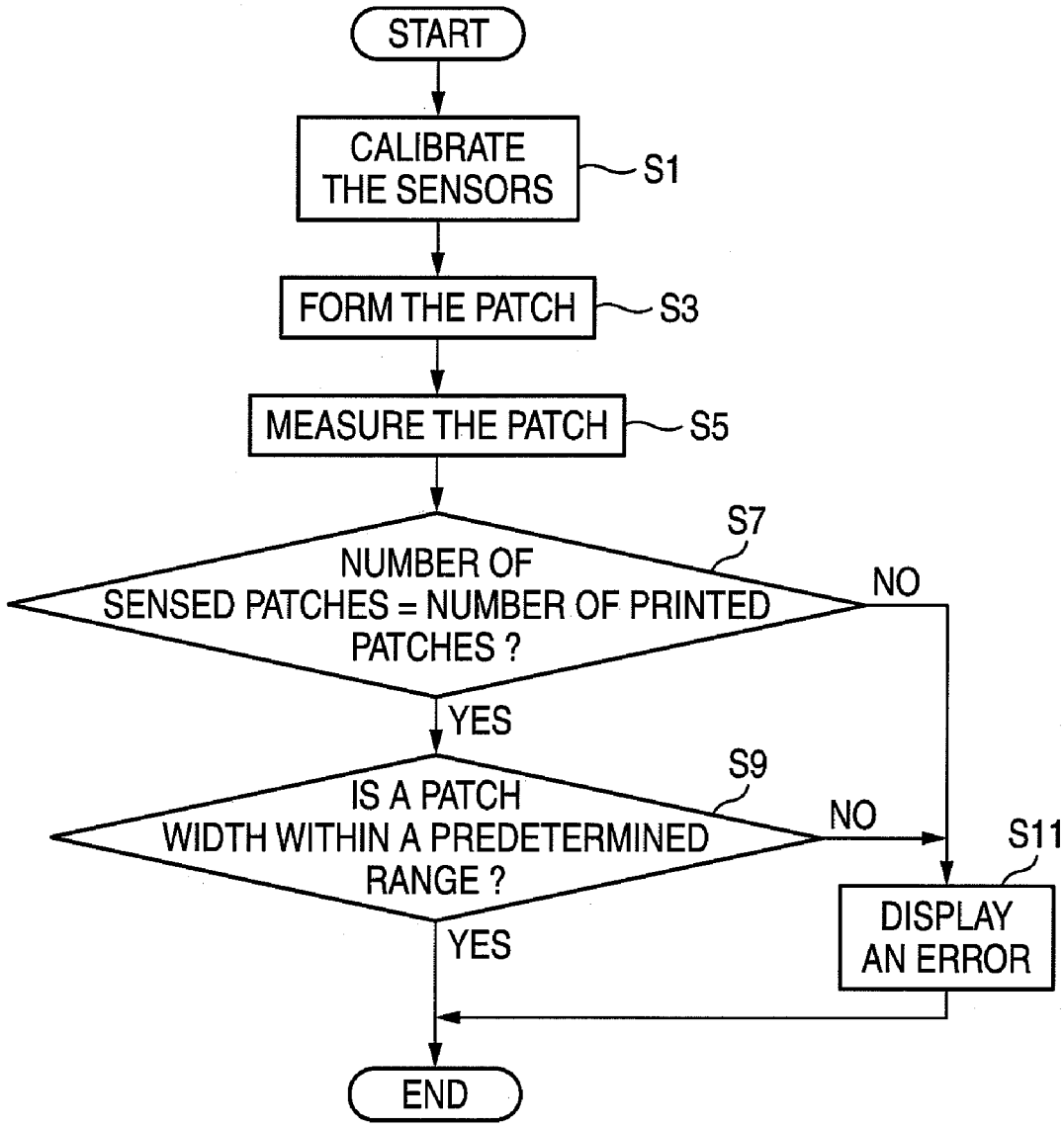
FIG. 10 is a flowchart showing a decision process of the exemplary embodiment of the image forming apparatus.

As shown in FIG. 10, in this process, a calibration of the sensors 60L, 60R is made in 51 (S as used herein corresponds to step). In 51, a process of gradually controlling a quantity of light of the infrared light emitting diode 61L, 61R to an adequate quantity of light by changing the duty ratio of the PWM signal output from the LED_PWM_L terminal or an LED_PWM_R terminal, and a process of also setting the comparator threshold to a predetermined patch sensing threshold value by controlling the PWM signal output from the TH_PWM terminal are executed.

In S3, a process of controlling the black LED unit 40 via the LED controller 72, while driving respective portions such as the carrying belt 23, and the like. is executed to form a plurality of patches P on the carrying belt 23 with the black toner T (an example of a mark forming unit). That is, in the present embodiment, the patches P are formed by using the LED unit 40, which is most distant from the shaft 5B of the top cover 5. At this time, the number of patches P, patch widths, and patch intervals are controlled by the LED controller 72 to have predetermined values that were previously set and are stored in the ROM 73 (an example of storing unit). Then, in S5, the number of patches P, the patch widths, and the patch intervals are measured based on the number of edges of the patches P and the intervals sensed when the sensor outputs of the registration sensors 60L, 60R (example of an edge detector) exceed the comparator threshold.

Then, in S7 and S9, the comparator 67L, 67R (an example of a deciding unit) decides whether or not the number of patches sensed in S5 (the number of sensed patches) is equal to the number of patches printed in S3 (the number of printed patches) (S7), and then the comparator 67L, 67R decides whether or not the patch width and the patch interval sensed in S5 are within predetermined, respective ranges. Here, the "predetermined ranges" are obtained by adding a slight error to the predetermined value employed in the control in S3. Then, the ranges are compared with respective average values of the patch width and the patch interval of a plurality of sensed patches P in S9.

If both S7 and S9, are decided affirmatively, it is determined that no focal shift has occurred, and the process is ended as is. Conversely, if the comparator 67L, 67R decides negatively in either S7 or S9, it is determined that a focal shift has been caused, and an error display indicating such an outcome is made on the display panel 71 in S11 and the process is then ended. Accordingly, the user is informed that a focal shift has been caused. In this case, in S11, not only can the error simply be displayed, but all other operations of the image forming apparatus 1 can also be inhibited.

In this manner, in the present embodiment, it is determined whether or not a focal shift has been caused, based on the sensed result of the edge of the patch P. Therefore, it can be decided exactly whether or not a focal shift is caused without the halftone mark (the patch, or the like), and thus there is no need that an expensive density sensor be employed. Also, in the event that a density of the halftone portion is increased as described above, there is a possibility that a density of the halftone portion is conversely decreased depending on the extent of a focal shift, and a conventional control system lacks control stability. However, like the present embodiment, when the sensed result of the edge is utilized, an accuracy of the above decision can be improved. Also, in S9, it is decided that the average values of the patch widths and the patch intervals of a plurality of patches P are within the predetermined ranges, so that an accuracy of the above decision can be further improved.

Also, in the present embodiment, the patches P are formed near both ends of the carrying belt 23, and the above process is applied to the patches P on each end of the belt separately. Therefore, when the above processed results of the left and right patches P are compared with each other, it can also be sensed whether or not the top cover 5 is twisted about the shaft 5B. Further, in the present embodiment, the patches P are formed by controlling the black LED unit 40 that is most distant from the shaft 5B of the top cover 5. The LED unit 40 that is provided most distantly from the shaft 5B is mostly easily influenced by the turning position of the top cover 5. Therefore, when the patches P are formed by such LED unit 40, it can be easily and precisely determined whether or not a focal shift is caused with respect to each LED unit 40.

Figure 11:
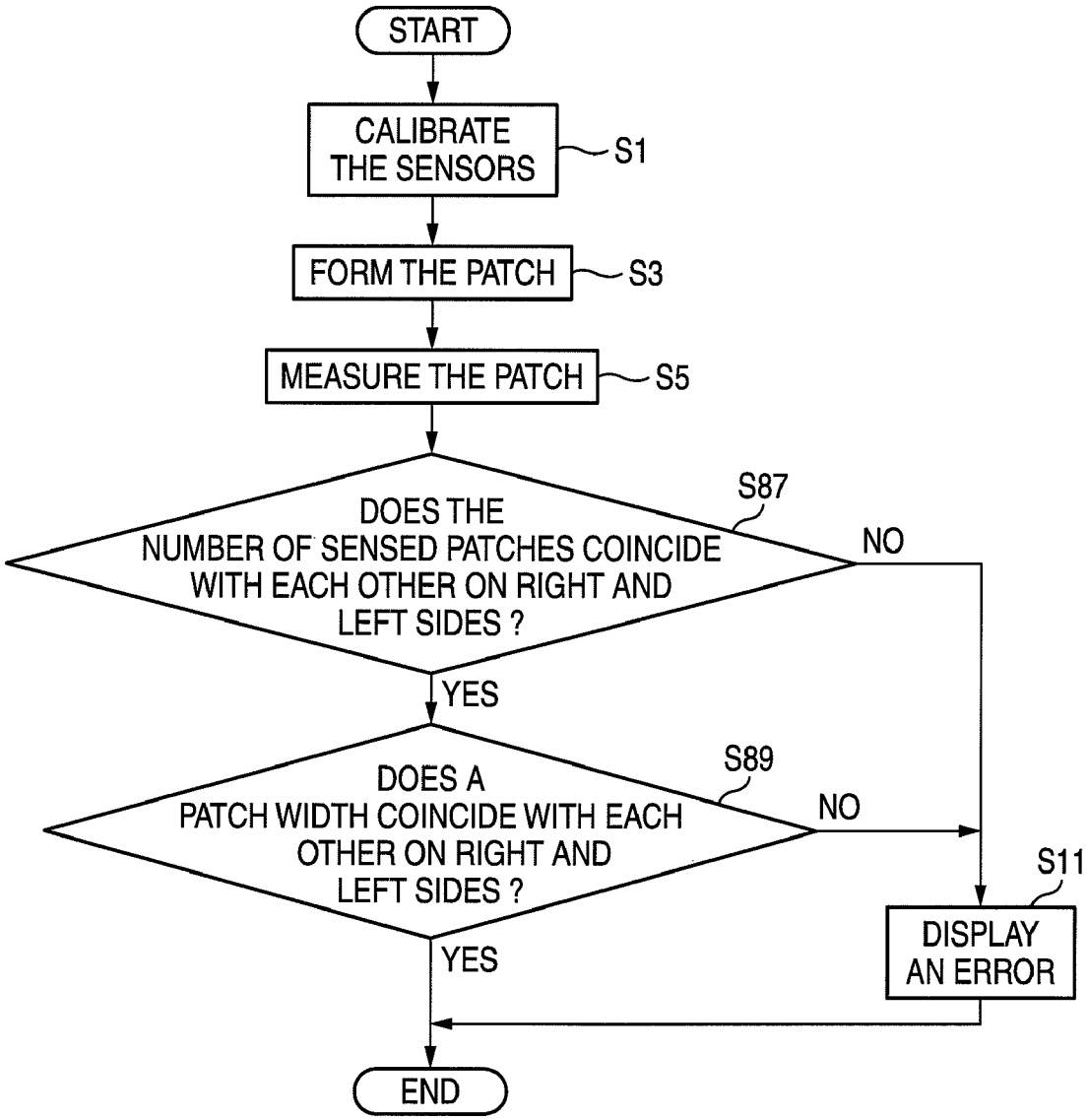
FIG. 11 is a flowchart showing a variation of the decision process of the exemplary embodiment of the image forming apparatus.

Embodiments of the present invention are not limited to the features of the above discussed embodiment, and can be embodied in various ways while not departing from the present invention. For example, in the above discussed embodiment, the number of patches P, the patch widths, and the patch intervals are compared with the predetermined values separately, but the left and right sensed results may be compared collectively. FIG. 11 is a flowchart showing such process. As shown in FIG. 11, this process is different from FIG. 10 in that it is decided in S87 instead of S7 whether or not the number of sensed patches coincide with each other on both the right and left sides, and also it is decided in S89 instead of S9 whether or not the patch widths and the patch intervals coincide with each other on both the right and left sides. The remaining steps are similar to the steps of FIG. 10.

Thus, in this embodiment, like the above discussed embodiment, it can be decided whether or not a focal shift has been caused. Also, in this embodiment, it is not necessary to store the predetermined ranges in the ROM 73, which can allow a production cost of the apparatus to be reduced. Further, in this embodiment, the above decision can also be made in a period during which a speed of the carrying belt 23 is not stabilized immediately after the apparatus is started.

Figure 12:
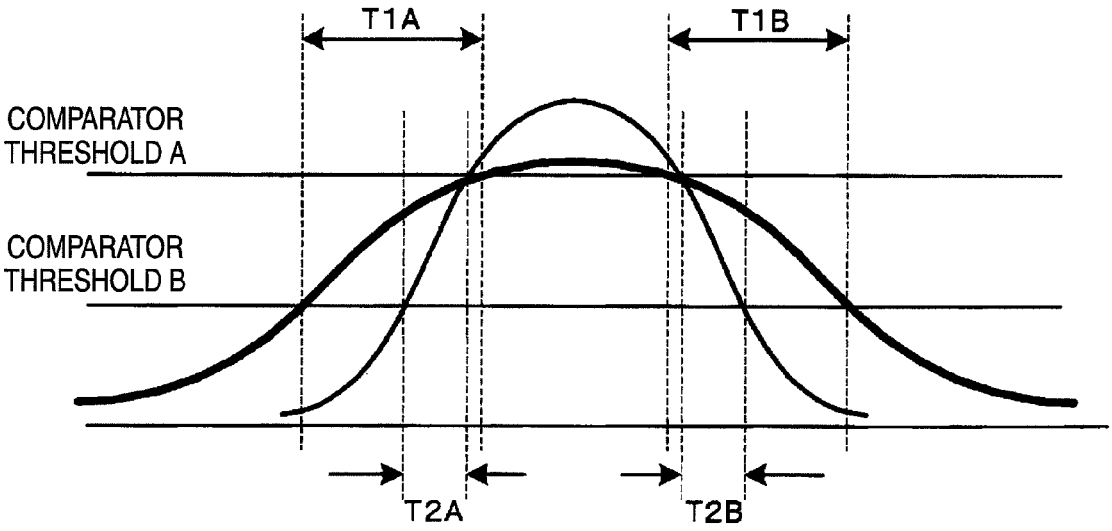
FIG. 12 is an explanatory view showing the focal shift decision process of the exemplary embodiment of the image forming using two threshold values.

Also, as indicated by a thick line in FIG. 12, a change of the sensor output when a focal shift occurs can become gentle in contrast to a change of the sensor output during the normal operation, as indicated by the thin line in FIG. 12. Therefore, different values A, B can be set as the comparator thresholds, and a focal shift may be sensed based on a difference in time when the sensor output passes sequentially across two comparator thresholds, i.e., an amount of displacement between two types of edges can be sensed in response to the comparator thresholds. In the sensor outputs shown in FIG. 12, when a focal shift is caused, a time required until the sensor output exceeds the higher comparator threshold A, after the sensor output exceeds the lower comparator threshold B is assumed as T1A, and this time T1A is longer than the time T2A that is required during the normal operation. Also, a time T1B required until the sensor output falls below the lower comparator threshold B after the sensor output falls below the higher comparator threshold A is prolonged in comparison to the time T2B required during the normal operation.

As a result, in a situation that a time required until the sensor output exceeds the comparator threshold A after the sensor output exceeds the comparator threshold B is assumed as TnA and a time required until the sensor output falls below the lower comparator threshold B after the sensor output falls below the higher comparator threshold A is assumed as TnB, when the larger of TnA and TnB exceeds a predetermined value that is set slightly larger than T2A, T2B, it can be regarded that a focal shift has been caused.

Figure 13:
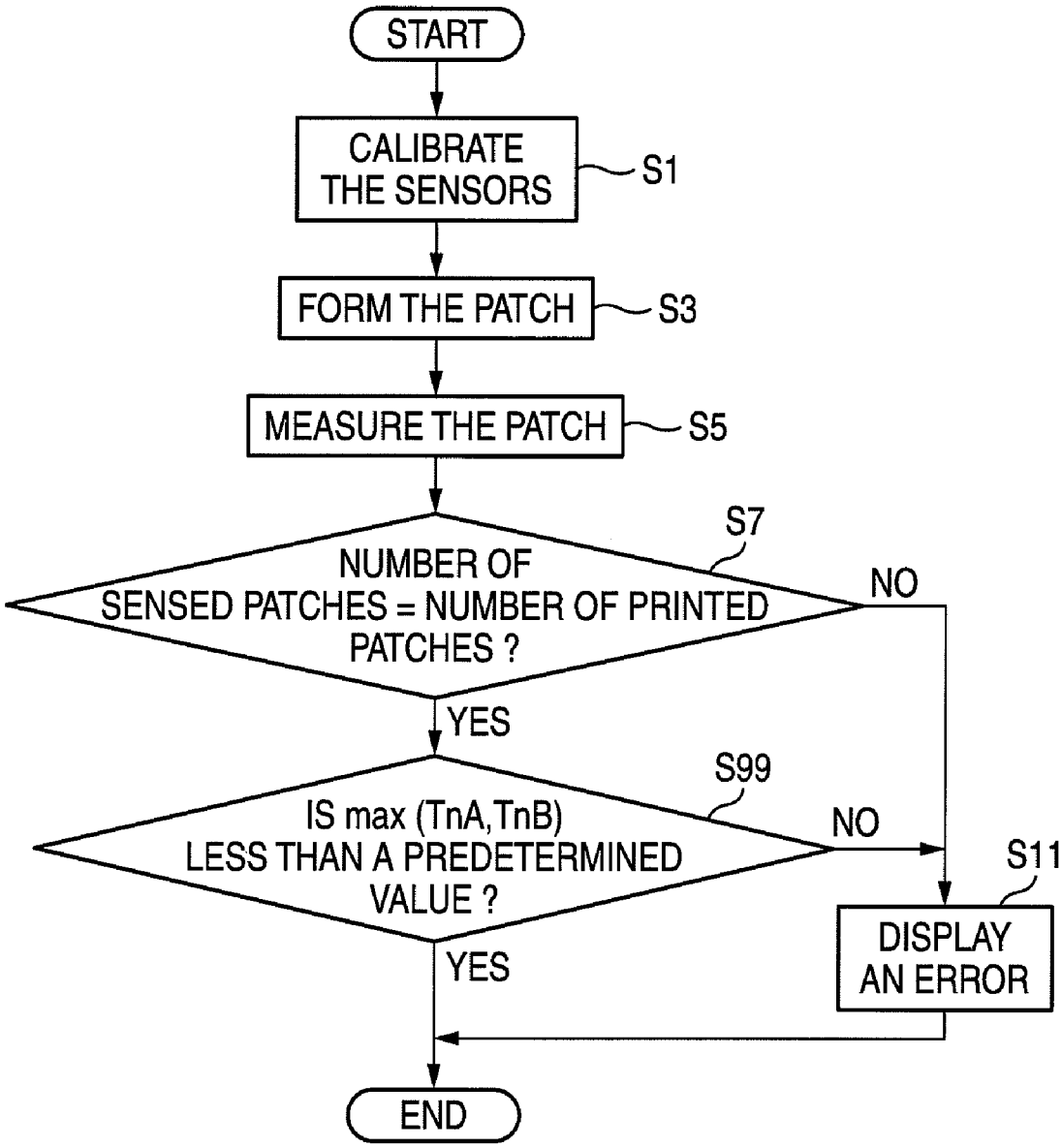
FIG. 13 is a flowchart showing a process based on the decision process shown in FIG. 12.

FIG. 13 is a flowchart showing this process for detecting a focal shift. As shown in FIG. 13, this process is different from FIG. 10 in that it is decided in S99, instead of S9, whether or not a larger one out of TnA and TnB is less than a predetermined value. The remaining steps are constructed similarly to those in FIG. 10. In this case, like the above discussed embodiment, it can be decided whether or not a focal shift has been caused. Also, in this case, an accuracy of the decision can be improved by utilizing two comparator thresholds A, B.

In the above embodiments, the number of sensed patches P is referred to in all processes (S7, S87), but this process may alternatively be omitted. Conversely, it may be decided whether or not a focal shift is caused, based on the number of sensed patches only. In the latter case, a necessity of employing a timer in the process is eliminated and, for example, only a counter may be provided to the ASIC 70. Thus, a configuration of the apparatus can be simplified. The interval between the patches P formed on the carrying belt 23 may be gradually changed. In this case, the extent of a focal shift can be determined that the number of sensed patches P is reduced from that in the normal operation.

In the above embodiments, the number of patches P, the patch widths, and the patch intervals are compared with the predetermined values to decide the focal shift. However, in the case that the plurality of patches are formed and the light sensors continuously senses the patches, the output of the comparator becomes a pulse signal. Thus, since a duty ratio of the output of the comparator is correlated with the number of patches, the patch widths, and the patch intervals, the focal shift can be decided by detecting a duty ratio of the output of the comparator and deciding whether or not the detected duty ratio falls within a predetermined range.

Further, in this embodiment, the patches P are formed on the carrying belt 23 which is the carrier body. But an intermediate transfer belt or drum may be employed as the carrier body or a recording medium such as the paper, or the like may be employed. Further, the mode of the patches P is not limited to the above modes, and various modes can be employed. Further, a pair of patches may not always be formed on both the left and right sides, and only one patch may be formed on only one side. Further, while the plural patches are formed on the carrying belt 23 in the above embodiment, a single pitch may be formed on the carrying belt 23. Further, while the patch is formed by one of the image forming units 30 and the focal shift is detected for the one of the image forming units 30, the patch may be formed by all the image forming units and the focal shift may be detected for each of the image forming units 30. In the case that the patch is formed by one of the image forming units 30 and the focal shift is detected for the one of the image forming units 30, it is preferable to form the patch by and detect the focal shift for the image forming unit 30 for black color. Further, the present invention can be applied to a monochromatic image forming apparatus.

What is claimed is:

1. An image forming apparatus, comprising:

a photosensitive body;

an exposing unit which exposes a surface of the photosensitive body to form an electrostatic latent image on the surface of the photosensitive body;

a developing unit which attaches a developer to the electrostatic latent image to form a developer image corresponding to the electrostatic latent image formed on the surface of the photosensitive body;

a carrier body, which is moved through a portion opposite to the photosensitive body and onto which the developer image formed on the photosensitive body is to be transferred;

a mark forming unit which controls the exposing unit to form a mark made from the developer image on a surface of the carrier body;

a light sensor which senses light reflected by the carrier body;

an edge detector which senses edges of the mark formed on the surface of the carrier body based on an output of the light sensor; and a deciding unit which decides a positional relation between a focal point of the exposing unit and the surface of the photosensitive body based on the detected edge detected by the edge detector.

2. The image forming apparatus according to claim 1, wherein the deciding unit decides whether or not light from the exposing unit is focused on the surface of the photosensitive body, based on whether or not a mark width, which is calculated based on an interval between the detected edges, corresponds to a predetermined width.

3. The image forming apparatus according to claim 2, wherein the mark forming unit forms, on the surface of the carrier body, a plurality of the marks having a predetermined width along a length in a moving direction of the carrier body, and the deciding unit decides whether or not light from the exposing unit is focused on the surface of the photosensitive body, by determining whether or not an average value of widths of the marks, calculated based on the intervals between the detected edges, corresponds to the predetermined width.

4. The image forming apparatus according to claim 1, wherein the mark forming unit forms, on the surface of the carrier body, a plurality of marks along a length in a moving direction of the carrier body, and the deciding unit decides whether or not light from the exposing unit is focused on the surface of the photosensitive body by determining whether or not a number of marks, calculated based on a number of detected edges, corresponds to a predetermined number.

5. The image forming apparatus according to claim 1, wherein the edge detector detects two types of mark edges based on whether or not the sensed light exceeds one of two thresholds which are different in an intensity of light sensed by the light sensor, and the deciding unit decides whether or not light from the exposing unit is focused on the surface of the photosensitive body, by determining on whether or not a displacement amount between the two types of edges corresponds to a predetermined amount of displacement.

6. The image forming apparatus according claim 1, further comprising:

a main body on which the developing unit and the photosensitive body are provided;

a holding unit which holds the exposing unit, wherein the holding unit is rotatable with respect to the main body about a shaft, which intersects orthogonally a direction in which the carrier body passing through the portion opposite to the photosensitive body moves, wherein the holding unit is moved closer to or further from the photosensitive body by being rotated about the shaft, wherein the mark forming unit forms a pair of marks, on the surface of the carrier body, along distance in an axial direction of the shaft, wherein the light sensor senses light reflected to the carrier body from a respective position at which each of the pair of marks is formed, wherein the edge detector senses the edge of each of pair of marks separately, and wherein the deciding unit makes a decision based on results of the edge detector sensing the pair of marks.

7. The image forming apparatus according to claim 1, further comprising:

a main body on which a plurality of the photosensitive bodies and a plurality of developing units are provided; and a holding unit which holds a plurality of the exposing units which are arranged so as to correspond to the plurality of photosensitive bodies and the plurality of developing units, wherein the holding unit is rotatable about a shaft, which intersects orthogonally a direction in which the carrier body passing through the portion opposite to the plurality of photosensitive bodies moves, wherein the holding unit is moved closer to or further from the plurality of photosensitive bodies by being rotated about the shaft, and wherein the mark forming unit forms the mark by controlling the exposing unit disposed furthest from the shaft.

8. The image forming apparatus according to claim 1, further comprising a displaying unit which displays a result when the deciding unit decides that the light from the exposing unit is not focused on the surface of the photosensitive body.

* * * * *